US007594581B2

(12) United States Patent
Lapoint, III

(10) Patent No.: US 7,594,581 B2
(45) Date of Patent: Sep. 29, 2009

(54) COLLAPSIBLE CONTAINER

(75) Inventor: John H. Lapoint, III, Kennebunk, ME (US)

(73) Assignee: Wrangler Corporation, Auburn, ME (US)

( * ) Notice: Subject to any disclaimer, the term of this patent is extended or adjusted under 35 U.S.C. 154(b) by 719 days.

(21) Appl. No.: 11/054,532

(22) Filed: Feb. 9, 2005

(65) Prior Publication Data

US 2006/0175328 A1 Aug. 10, 2006

(51) Int. Cl.
*B65D 6/12* (2006.01)

(52) U.S. Cl. ..... 220/4.28; 229/117.35

(58) Field of Classification Search ..... 220/4.28, 220/62.21, 62.22, 656, 658; 383/105, 111, 383/119; 229/117.29, 117.33
See application file for complete search history.

(56) References Cited

U.S. PATENT DOCUMENTS 3,194,471 A * 7/1965 Murphy ..... 229/117.29
3,385,504 A * 5/1968 Adams ..... 229/125.21
3,865,269 A 2/1975 Coleman
3,883,065 A 5/1975 Presnick
4,426,015 A 1/1984 Preston et al.
4,903,859 A * 2/1990 Derby et al. ..... 383/41
5,323,922 A 6/1994 LaPoint, Jr. et al.
5,664,887 A 9/1997 LaFleur
6,000,604 A 12/1999 LaPoint, III
6,520,403 B1 2/2003 LaPoint, III

* cited by examiner

*Primary Examiner*—Harry A Grosso
(74) *Attorney, Agent, or Firm*—Pierce Atwood LLP; Kevin M. Farrell; Katherine A. Wrobel

(57) ABSTRACT

The present invention includes a collapsible container defined by a continuous rigid structure and an interior liner that is uniformly affixed thereto. The continuous rigid structure is preferably four-sided such that it defines four continuous surfaces of a cube. The continuous rigid structure is collapsible due to at least one scoring line defined on at least one surface thereof. The liner is integrally affixed to each of the four sides and additionally provides a fifth side that forms the bottom of the container. A protective cover is secured to the exterior of the continuous rigid structure for protecting the contained materials against the elements. The cover can be selectively sealed for rendering the container of the present invention substantially impervious to the elements.

13 Claims, 5 Drawing Sheets

COLLAPSIBLE CONTAINER

BACKGROUND OF THE INVENTION

1. Field of the Invention

The present invention relates to containers for storing and/or transporting materials. More particularly, the present invention relates to collapsible containers that may be employed to transport bulk materials including, but not limited to, hazardous materials.

2. Summary of the Related Art

Metal containers are generally used to store and transport bulk materials, particularly hazardous materials. These metal containers are expensive to purchase, rent and store. They are fairly large and therefore require a considerable amount of space to maintain on site. That required space could be considerable, dependent upon the amount of material that must be stored and/or transported. While the storage volume of metal containers is considerable, the volume of material that is storable within multiple containers is diminished by the fact that the metal containers are generally cylindrical in nature. Cylinders generally cannot be oriented in a space-efficient manner. As such, there is a need in the art for containers that will contain a high volume of material and be storable in a low volume storage facility.

To meet this need, bag containers have been employed. Such bags take up much less space when not in use. However, such bags are of insufficient physical characteristics for transport purposes. That is, they are generally not tough enough to stand up to the rigors of movement by mechanical devices such as forklifts, accidental drops into cargo holds, stacking, and the like. Moreover, bag containers are easily deformed by the materials that they contain. As such, bag containers are not reliably stackable, and hence bag containers do not provide for efficient transport or storing of voluminous materials.

In order to overcome the limitations associated with flexible bags and rigid metal boxes, a series of collapsible containers have been developed. While these containers provide storage and transport benefits, they lack the rigidity and impermeability to contain a wide range of materials, such as hazardous materials. Therefore, what is needed is a collapsible container for the storage and transport of bulk materials suitable for retaining a range of materials. What is also needed is a collapsible container that minimizes the exposure of the materials to the surrounding environment. Lastly, there is a need in the art for a collapsible container that can reliably hold its shape while stacked during storage and transport.

SUMMARY OF THE PRESENT INVENTION

Accordingly, the present invention provides a collapsible container defined by a continuous rigid structure and an interior liner that is uniformly affixed thereto. The continuous rigid structure is preferably four-sided, such that it defines four continuous surfaces of a cube. The liner is integrally affixed to each of the four sides and additionally provides a fifth side that forms the bottom of the container. A protective cover is secured to the exterior of the continuous rigid structure for protecting the contained materials against the elements.

The container of the present invention is selectively sealable via a pair of flaps that form part of the cover. The flaps are selectively attached to the exterior of the cover through a mechanical means, such as a loop and eyelet closure. In such a manner, the container can be easily and effectively sealed for stacking and transport without worry that the materials contained therein will be unnecessarily exposed to moisture and debris. The container of the present invention is also collapsible for storage and empty transport. A pair of scoring lines is defined on opposing sides of the continuous rigid structure such that the container can be folded inwards and collapse into a substantially planar square.

The container of the present invention thus provides numerous benefits over the existing art. Namely, the container of the present invention combines the rigidity of a metal container with the adaptability of a semi-rigid container. Moreover, the liner and cover cooperate to render the container of the present invention substantially impervious to environmental damage that otherwise might harm the materials within. Further features and advantages of the present invention are described in detail below with reference to the following drawings.

DETAILED DESCRIPTION OF THE PREFERRED EMBODIMENTS

The present invention provides a collapsible container that is rigid enough for stacking, storing and transporting a variety of materials. Unlike the ubiquitous metal containers, however, the container of the present invention can be collapsed from a substantially cubic volume into a substantially flat square for easy stacking and storage. The present invention thus provides numerous benefits to the user, as described more fully below with reference to the drawings.

Figure 1:
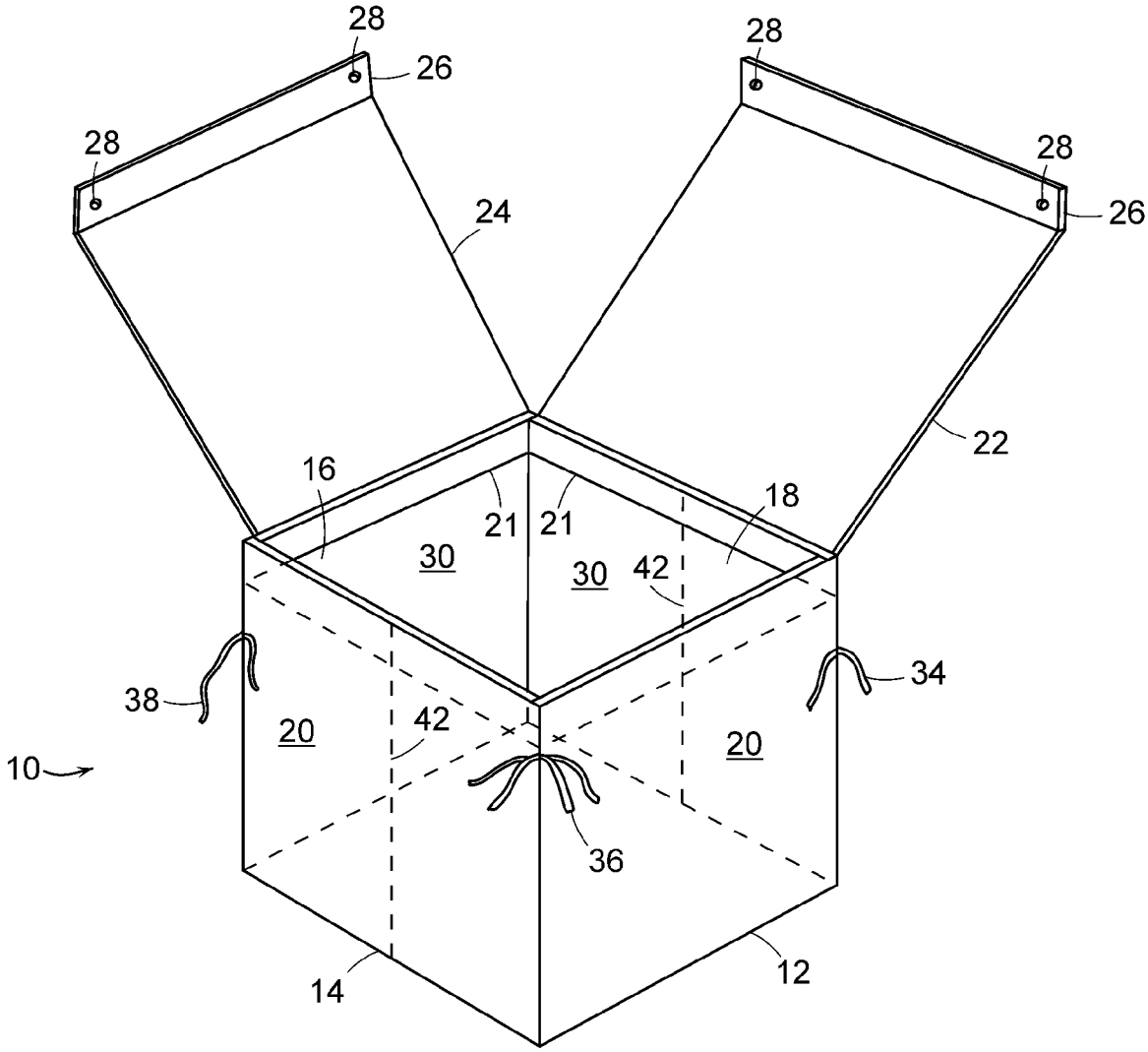
FIG. 1 is an elevated perspective view of the collapsible container of the present invention.

FIG. 1 is an elevated perspective view of the collapsible container 10 of the present invention. The container 10 preferably includes four sides 12, 14, 16, 18 that are arranged in a symmetrical fashion so as to form part of a cubic structure defining a cavity within which materials may be contained. The four sides 12, 14, 16, 18 are preferably integral portions of a continuous rigid structure. That is, the four sides 12, 14, 16, 18 are not structurally independent, and therefore provide a greater degree of rigidity and structural integrity than the current state of the art containers. The four sides 12, 14, 16, 18 preferably form a rigid structure composed of corrugated board or similar materials that may be readily manufactured while providing light weight, rigidity and ease of storage.

Although the container 10 of the present invention is substantially more rigid than existing containers, it is also readily collapsible and storable by a user. Two of the four sides 12, 14, 16, 18 include scoring lines 42 (depicted in phantom) that permit the four sides 12, 14, 16, 18 to be collapsed into a substantially planar structure as further described herein. The scoring lines 42 allow a user to collapse and store the present invention in the minimum amount of space while maintaining the structural rigidity of the container 10.

A cover 20 defines a substantially cubic form that is disposed over the four sides 12, 14, 16, 18. The cover 20 further defines a bottom (not shown), as well as two flaps 22, 24 that, in use, cooperate to enclose the contents of the container 10. The cover 20 also includes a plurality of tabs 21 that may be fixed to the interior of the four sides 12, 14, 16, 18 for securing the cover 20 to the four sides 12, 14, 16, 18. The plurality of tabs 21 may be affixed thereto by glue, epoxy, resin or any other adhesive that is known in the art.

The flaps 22, 24 include at least one end portion 26 for selectively engaging the cover 20 of the container 10, thereby securing its contents. Any conventional and secure fastening means may be used to secure an end portion 26 of a flap 24, 26 to a corresponding portion of the cover 20. For example, the end portions 26 may include a plurality of eyelets 28 which are adapted for receiving a plurality of ties 34, 36, 38 disposed on the exterior of the cover 20. The user may encapsulate the container 10 by folding flaps 22, 24 down over the cavity of the container 10 and affixing the end portions 26 to the plurality of ties 34, 36, 38 through the eyelets 28. As the cover 20 is preferably composed of a water resistant or waterproof material, the user can substantially insulate the container 10 against all kinds of moisture and corrosive elements by closing the flaps 22, 24 in the manner described above. It should be understood that the eyelet-tie mechanism is only one means by which the container 10 may be closed, and other similar mechanisms for selectively affixing two objects are equivalent to those described herein.

The four sides 12, 14, 16, 18 are sandwiched between the cover 20 and a liner 30 that is affixed to the four sides 12, 14, 16, 18 on the interior portion of the container 10. The liner 30 preferably includes a fifth surface (not shown) that forms the bottom portion of the container 10. The liner 30 is preferably form-fitted to the four sides 12, 14, 16, 18 and uniformly affixed thereto by glue, epoxy, resin or any other adhesive that is known in the art. The liner 30 is affixed to the four sides 12, 14, 16, 18 in such a manner so as to render it coplanar with each of the four sides 12, 14, 16, 18. That is, the liner 30 is affixed to substantially all of the interior surfaces of the respective four sides 12, 14, 16, 18. As the liner 30 also includes the bottom portion, the liner 30 and four sides 12, 14, 16, 18 substantially form five sides of a substantially symmetric cubic structure. The liner 30 is preferably composed of a water resistant or water proof synthetic material that is also resistive to degradation by temperature and corrosive compounds.

Figure 2:
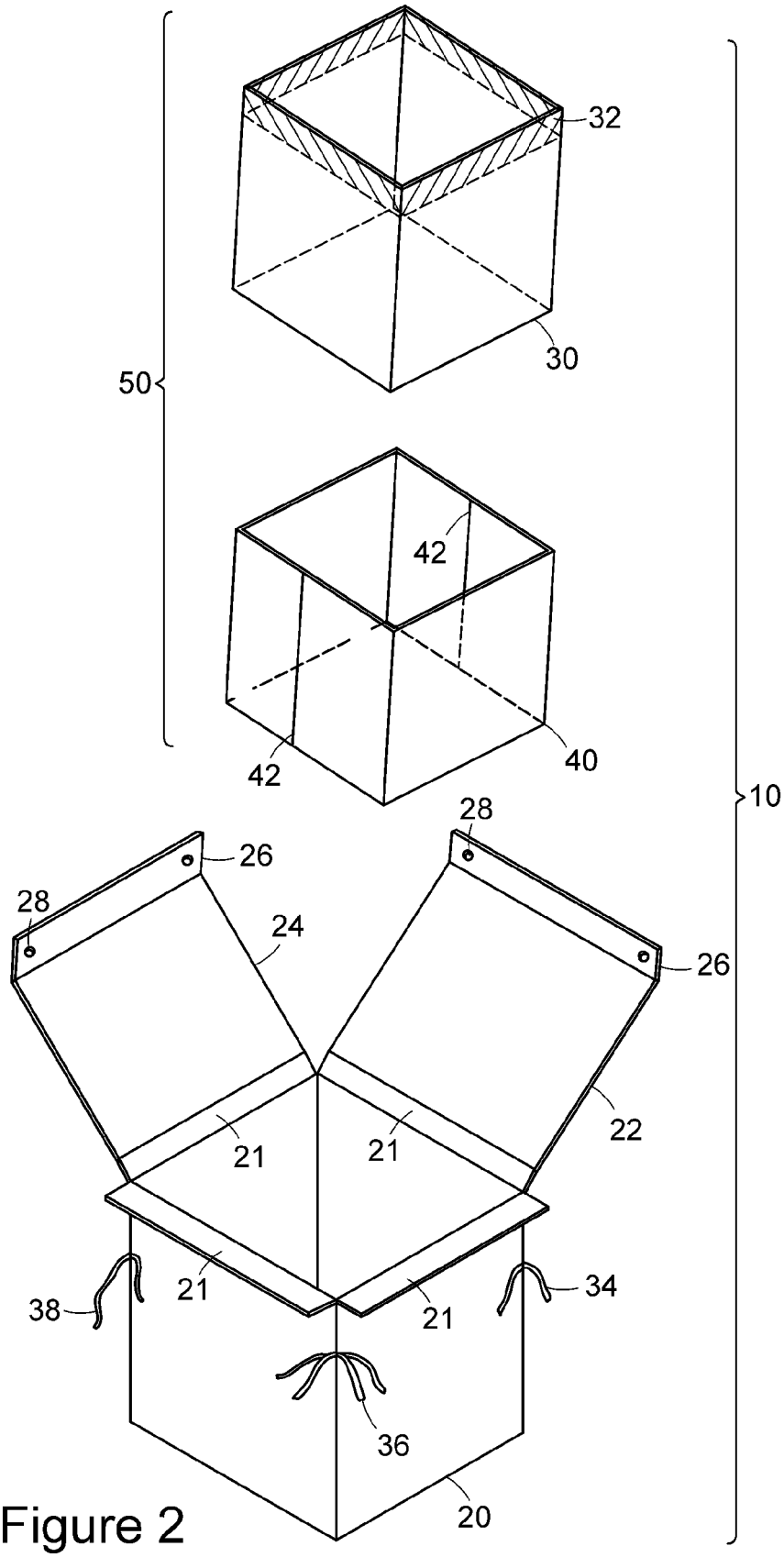
FIG. 2 is an exploded perspective view of the collapsible container of the present invention.

FIG. 2 is an exploded perspective view of the container 10 of the present invention. As shown, the continuous rigid structure 40 is shown having scoring lines 42 disposed thereon. As previously noted, the continuous rigid structure is preferably comprised of corrugated board, although other equivalent structures that provide the necessary rigidity, weight, and ease of use may also be used. The liner 30 is substantially similar in size and shape to the continuous rigid structure 40, except for its fifth side (not shown) that forms the bottom of the container 10. The liner 30 optionally includes a folding portion 32 (shown in cross-hatch) that is folded over the top of the continuous rigid structure 40 and affixed to the exterior thereof by glue, epoxy, resin or any other suitable adhesive material or method. In one embodiment of the container 10, the liner 30 may be gathered and sealed by any conventional means for containing the contents of the container 10. In a preferred embodiment, the liner 30 is uniformly affixed to the interior of the continuous rigid structure 40 so as to integrate the surfaces of the liner 30 with the inner surfaces of the continuous rigid structure 40. The resultant structure is referred to as an integrated rigid structure 50.

The continuous rigid structure 40 and liner 30, once formed into the integrated rigid structure 50, can be fit within the cover 20. The plurality of flaps 21 are then folded over the integrated rigid structure 50 and affixed to the interior thereof. That is, the flaps 21 are affixed to the liner 30, which has been previously affixed to the continuous rigid structure 40, so as to prevent any exposure of the continuous rigid structure 40 to the elements or the materials stored in the container 10.

Figure 3:
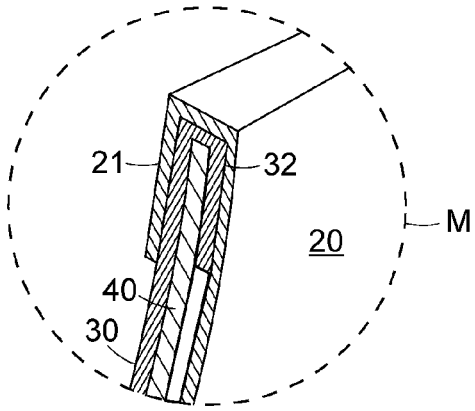
FIG. 3 is a partial cut-away elevated perspective view of the collapsible container of the present invention, a portion of which is magnified for descriptive purposes.
Figure 3:
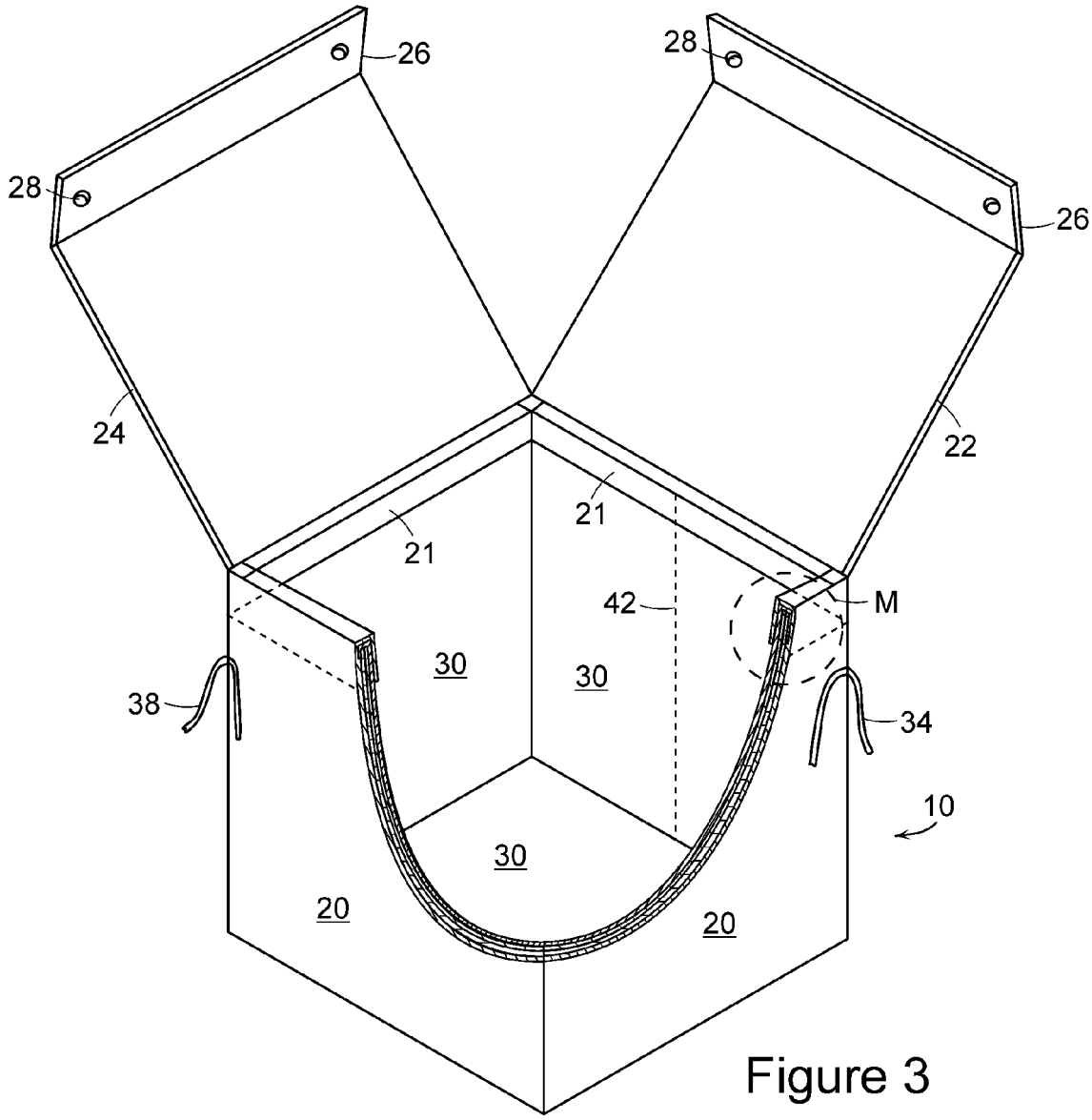

The interplay between the cover 20, liner 30 and continuous rigid structure 40 can be seen in FIG. 3, which is a partial cut-away elevated perspective view of the collapsible container of the present invention, a portion of which is magnified for descriptive purposes. The magnified portion M depicts the top edge of the container 10 where the continuous rigid structure 40 forms the core of a series of overlapping materials. As shown, the liner 30 is disposed on one side of the continuous rigid structure 40, and the cover 20 is disposed on its opposite side. The foldable portion 32 is folded over the continuous rigid structure 40 and disposed underneath the cover 20, while the tab 21 is folded over the continuous rigid structure 40 and the foldable portion 32, and affixed to the interior of the liner 30. As shown therefore, both the tab 21 and the foldable portion 32 protect the top of the continuous rigid structure 40 from any elemental interference. Also shown in FIG. 3 is the bottom portion of the liner 30 that comprised the bottom portion of the container 10.

Figure 4:
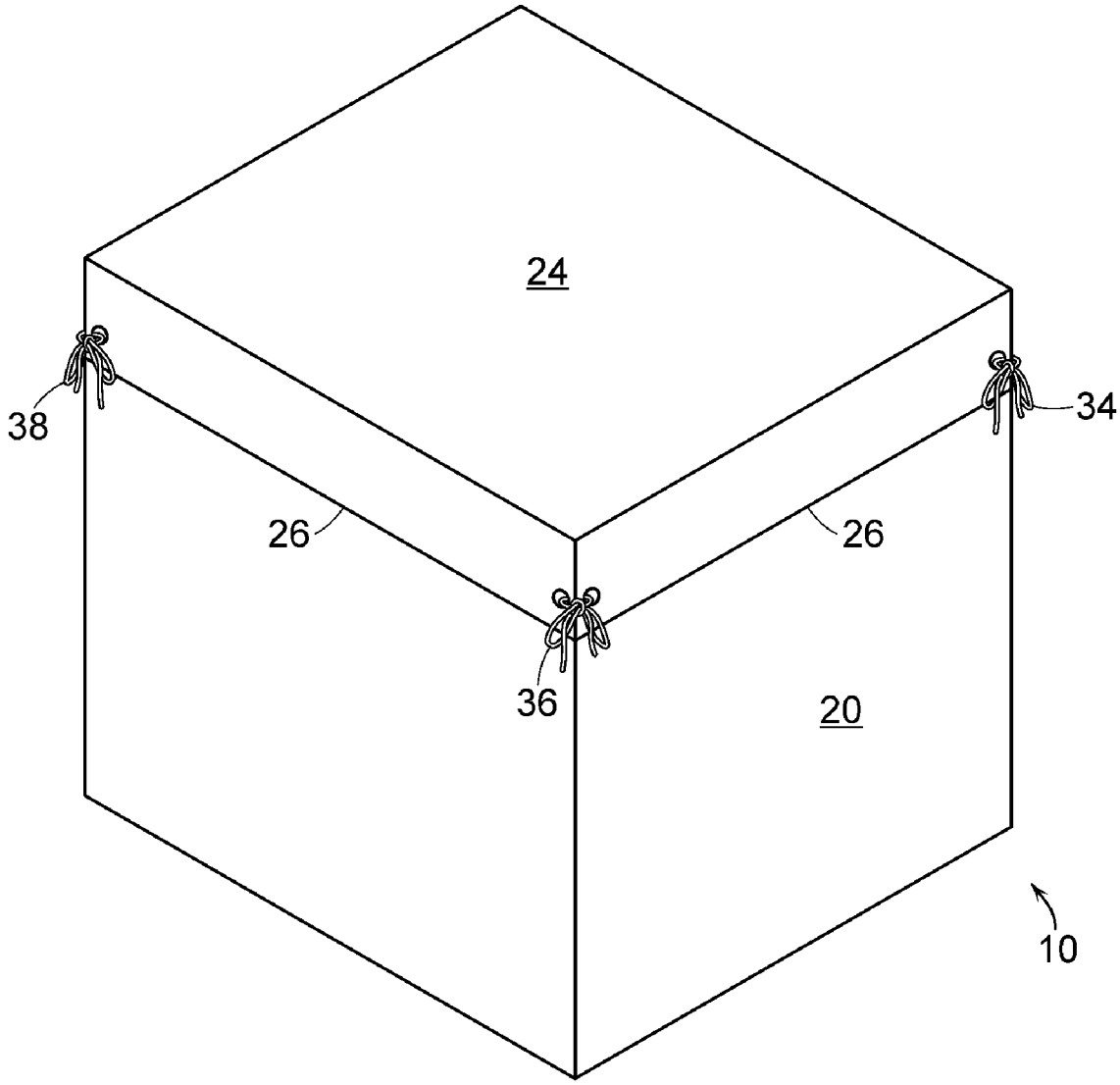
FIG. 4 is an elevated perspective view of a sealed collapsible container in accordance with the present invention.

FIG. 4 is an elevated perspective view of a sealed collapsible container 10 in accordance with the present invention. As shown, the flaps 22 (not visible), 24 are folded over the container 10 such that the end portions 26 are aligned with the plurality of ties 34, 36, 38. The plurality of ties 34, 36, 38 may be looped through the eyelets 28 on the end portions 26 in order to secure the flaps 22, 24 and seal the container 10. It should be noted that only flap 24 is shown in FIG. 4, but it is understood that flap 22 also could have been shown. In either arrangement, the container 10 is sealable against the elements, and in particular, the contained materials are shielded from moisture and debris.

Figure 5:
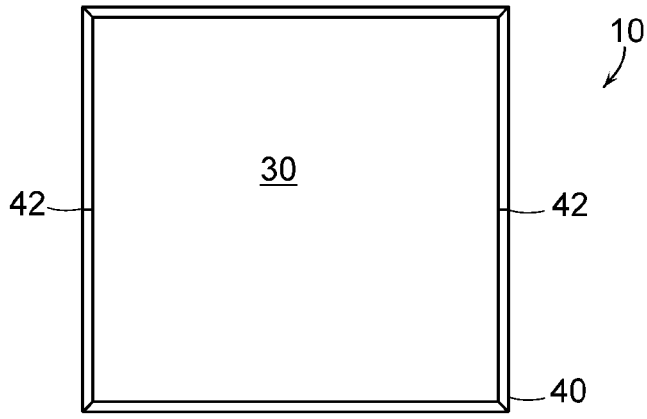
FIGS. 5, 6 and 7 are a series of partial plan views of the present invention illustrating the mechanism by which the container is collapsed.
Figure 6:
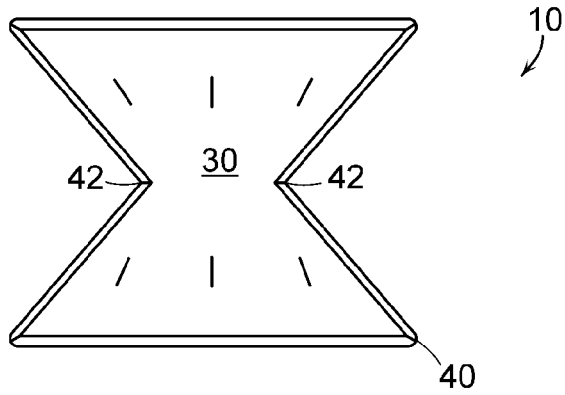
Figure 7:
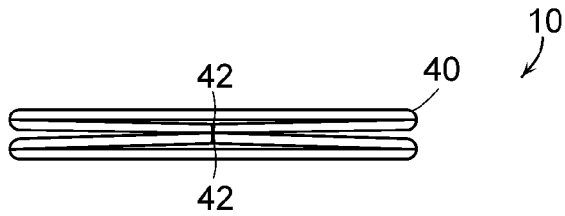

FIGS. 5, 6 and 7 are a series of partial plan views of the present invention illustrating the mechanism by which the container is collapsed. Unlike existing semi-rigid containers, the container of the present invention 10 is collapsible into a small area for easy storage and transport.

FIG. 5 is a partial plan view of the container 10 of the present invention omitting the cover 20. As shown, the surface of the bottom of the container 10 is the liner 30. Scoring lines 42 are shown disposed on opposing sides of the continuous rigid structure 40. It should be noted that the scoring lines 42 are symmetrically placed about the continuous rigid structure 40 such that the container 10 is collapsible into a small space, through the introduction of an accordion-fold, without stretching the liner 30 and cover 20 (not shown) which comprise the bottom of the container 10. The scoring lines 42 are disposed on the continuous rigid structure 40 such that it is readily collapsible as described. However, the scoring lines 42 are not sufficiently deep so as to damage or diminish the structural integrity of the present invention.

FIG. 6 is a partial plan view of the container 10 of the present invention shown at a midpoint during its collapse. FIG. 7 a partial plan view of the container 10 of the present invention in its collapsed state wherein it forms a substantially planar object that is substantially square and easily stored and transported.

The container 10 of the present invention as described herein provides a number of tangible benefits over the existing rigid and semi-rigid containers known in the art. The container of the present invention is rigid enough for stacking, storing and transporting a variety of materials that other semi-rigid containers cannot handle. Moreover, unlike the rigid metal containers, the container of the present invention can be collapsed from a substantially cubic volume into a substantially flat square for easy stacking and storage.

It should be apparent to those skilled in the art that the above-described embodiments are merely illustrative of but a few of the many possible specific embodiments of the present invention. Numerous and various other arrangements can be readily devised by those skilled in the art without departing from the spirit and scope of the invention as defined in the following claims.

I claim:

1. A container comprising:

a continuous rigid structure defining a plurality of outer surfaces and a plurality of inner surfaces, the continuous rigid structure including a first scoring line and a second scoring line rendering the continuous rigid structure collapsible;

a liner uniformly affixed to each of the plurality of inner surfaces, the liner further defining a folding portion, the folding portion affixed to each of the plurality of outer surfaces, the liner defining an interior within which material can be contained;

a cover defining an exterior, the cover further defining a first flap selectively attachable to the exterior, the cover further defining a first tab affixed to the interior of the liner.

2. The container of claim 1 further comprising a second tab, a third tab and a fourth tab, the second, third, and fourth tabs affixed to the interior of the liner.

3. The container of claim 1 further comprising a second flap selectively attachable to the exterior of the cover.

4. The container of claim 1 further comprising a plurality of ties for selectively attaching the first flap to the exterior.

5. The container of claim 1 wherein the continuous rigid structure defines four inner surfaces and four outer surfaces.

6. The container of claim 5 wherein the first scoring line and the second scoring line are on opposing surfaces of the continuous rigid structure.

7. The container of claim 3 further comprising a plurality of eyelets defined on the first flap and the second flap.

8. The container of claim 1 wherein the continuous rigid structure is comprised of corrugated board.

9. A collapsible container comprising:

an integrated rigid structure including a continuous rigid structure comprising a first scoring line and a second scoring line, wherein the first scoring line and the second scoring line are on opposing surfaces of the continuous rigid structure, and a liner integrally affixed to a first surface of the continuous rigid structure the liner further defining an interior within which material can be contained and a folding portion affixed to a second surface of the continuous rigid structure;

a cover affixed to the second surface of the continuous rigid structure, the second surface distinct from the first surface, the cover further defining a first flap and a second flap for selectively sealing the container and further defining a first tab affixed to the interior surface of the liner.

10. The container of claim 9 further comprising a plurality of ties for selectively attaching the first and second flap to an exterior of the cover.

11. The container of claim 9 wherein the continuous rigid structure defines four inner surfaces and four outer surfaces.

12. The container of claim 9 further comprising a plurality of eyelets defined on the first flap and the second flap.

13. The container of claim 9 wherein the continuous rigid structure is comprised of corrugated board.

* * * * *